US007406985B2

(12) United States Patent
Heger et al.

(10) Patent No.: US 7,406,985 B2
(45) Date of Patent: Aug. 5, 2008

(54) PAPERMAKING SCREEN

(75) Inventors: Wolfgang Heger, Nideggen (DE); Klaus Fichter, Jüchen (DE)

(73) Assignee: Andreas Kufferath GmbH & Co. KG, Düren (DE)

( * ) Notice: Subject to any disclaimer, the term of this patent is extended or adjusted under 35 U.S.C. 154(b) by 0 days.

(21) Appl. No.: 11/414,560

(22) Filed: May 1, 2006

(65) Prior Publication Data

US 2007/0157988 A1 Jul. 12, 2007

(30) Foreign Application Priority Data

Jan. 11, 2006 (DE) ..... 10 2006 001 388

(51) Int. Cl.
*D21F 7/08* (2006.01)
*D03D 25/00* (2006.01)

(52) U.S. Cl. ..... 139/383 A; 162/358.2; 162/900; 162/902

(58) Field of Classification Search ..... 162/348, 162/902, 903, 358.2; 139/383 A, 383 AA, 139/383 R; 442/203–208, 239
See application file for complete search history.

(56) References Cited

U.S. PATENT DOCUMENTS 4,605,585 A * 8/1986 Johansson ..... 442/2
4,739,803 A * 4/1988 Borel ..... 139/383 A
5,092,372 A * 3/1992 Fitzka et al. ..... 139/383 A
5,152,326 A * 10/1992 Vohringer ..... 139/383 A
5,564,475 A * 10/1996 Wright ..... 139/383 A
5,826,627 A * 10/1998 Seabrook et al. ..... 139/383 A
5,865,219 A * 2/1999 Lee et al. ..... 139/383 A
5,881,764 A * 3/1999 Ward ..... 139/383 A
6,334,467 B1 * 1/2002 Barrett et al. ..... 139/383 A
6,896,009 B2 * 5/2005 Ward ..... 139/383 A
7,048,829 B2 * 5/2006 Heger et al. ..... 162/348
7,048,830 B2 * 5/2006 Heger et al. ..... 162/348
2007/0157988 A1 * 7/2007 Heger et al. ..... 139/383 A

FOREIGN PATENT DOCUMENTS

WO WO 02/00996 * 1/2002

* cited by examiner

*Primary Examiner*—Gary L. Welch
*Assistant Examiner*—Bobby H Muromoto
(74) *Attorney, Agent, or Firm*—Roylance, Abrams, Berdo & Goodman, L.L.P.

(57) ABSTRACT

A papermaking screen, especially for the sheet forming zone, has one paper side and one machine side with a first type of transverse yarns of the paper side and a second type of transverse yarns (25 to 40) of the machine side. The transverse yarns are woven with at least one type of longitudinal yarns (41 to 56). The longitudinal yarns (41 to 56) on the machine side within the machine-side pattern repeat bind two respective transverse yarns of the second type (25, 28; 31, 34; 37, 40). The division of the intersections for the longitudinal yarns is then improved, so that marks in the paper to be produced are prevented to the greatest extent possible.

9 Claims, 4 Drawing Sheets

PAPERMAKING SCREEN

FIELD OF THE INVENTION

The present invention relates to a papermaking screen, especially for the sheet forming zone having one paper side and one machine side. The papermaking screen has a first type of transverse yarns on the paper side and a second type of transverse yarns on the machine side, which are woven with at least one type of longitudinal yarns. Two adjacent longitudinal yarns form pairs, which in alternation on the paper side form a plain weave. Within the pattern repeat, at least one respective intersection of the first type and one intersection of the second type are formed, and alternate with the formation of at least two different intersections within a repeat to the machine side. One part of the second type of transverse yarns are bonded by at least two longitudinal yarns within a repeat.

BACKGROUND OF THE INVENTION

The dewatering of the fiber suspension by filtration is an important process within the papermaking process. The fiber suspension is a mixture of wood or cellulose fibers, fillers, auxiliary chemical agents and mainly water. This filtration process, which is often also called sheet formation, takes place in the sheet forming part of the wet part of the papermaking machine.

To be able to produce a paper sheet as uniform as possible, it is necessary to increase the amount of water to approximately 99% within the fiber suspension immediately before sheet formation. During the sheet forming process, this proportion is reduced to approximately 80% by filtration. The paper fibers and the fillers and auxiliary agents remain as fiber mat on the papermaking screen.

While in the past dewatering took place mainly by the papermaking screen on Fourdrinier paper machines, double screen machines are being used more and more often today, preferably so-called gap formers. They are characterized in that the fiber suspension is sprayed into a gap formed by two papermaking screens. Dewatering takes place at the same time by two screens to significantly accelerate the filtration process and the production rate of the papermaking machine. At present, papermaking machines for the sanitary paper domain have speeds of more than 2,000 meters/min.

These extreme conditions in the papermaking machine require sheet forming screens designed especially for this purpose and offering high fiber support with high stability and openness. In addition, a low tendency to marking of the fabric, that is to say, high fabric uniformity, is necessary especially for the domain of graphic paper.

A fabric or papermaking screen which most satisfies these requirements is described in DE 100 30 650 C1.

SUMMARY OF THE INVENTION

An object of the present invention is to provide an improved papermaking screen in terms of its operating properties.

This object is basically achieved by a papermaking screen for a sheet forming zone comprising a paper side having first transverse yarns and a machine side having second traverse yarns. Pairs of adjacent longitudinal yarns alternate on the paper side to form a plain weave with the first transverse yarns. The yarns of each of the pairs form first and second different crossings within one pattern repeat in extending between the first and second transverse yarns. The first and second crossings alternate. Part of the second yarns is bound by at least two of the longitudinal yarns within the one pattern repeat. The longitudinal yarns on the machine side bind two second transverse yarns within a machine-side pattern repeat by extending on outer sides thereof remote from the paper side.

Since the longitudinal yarns on the machine side within the machine-side pattern repeat bind two transverse yarns each of the second type, the division of the intersections for the longitudinal yarns is improved. Marks in the paper to be produced are for the most part prevented. This binding for the indicated transverse yarns by the longitudinal yarns takes place without their alternating between the pairs of bound transverse yarns onto the paper side. The weft ratio of the yarn system on the paper side to the yarn system on the machine side leads to a largely closed bottom side or machine side with still good dewatering performance. Disruptive operating noise and wear by increased abrasion of the machine-side transverse yarns are thus avoided.

The present invention furthermore makes it possible to reduce the transverse yarns on the machine side in diameter so that so-called water entrainment cannot occur. This phenomenon is caused when the screen, after leaving the sheet forming zone, cannot be emptied or not adequately emptied by the dewatering elements. The residual water on a deflection roller of the papermaking machine is hydroextracted out of the fabric by the resulting centrifugal forces. In addition to unpleasant mist formation, in the extreme case, the entrained water droplets can fall back onto the paper web and there result in hole formation. This hole formation then results in unusable paper qualities. The fabric of the present invention is especially suited to high speed papermaking machines and to papermaking in the graphics domain which calls for very high production qualities.

The tendency of the upper fabric, that is, the paper side of the screen, to marking is preferably reduced by the number of intersections for the longitudinal yarns being reduced relative to the number of upper wefts used in the form of transverse yarns of the first type and the number of upper wefts in the form of transverse yarns of the first type being increased between adjacent warp intersections. Furthermore, to reduce the tendency to marks when the fabric is being made, it is possible to move the location of the warp intersections between two adjacent warp pairs farther away from each other.

In one especially preferred embodiment of the papermaking screen according to the present invention, the machine side is made uniform by a larger number of machine-side transverse yarns of the second type, which are slightly thinner in cross section, being placed within the repeat by the altered weft ratio. In this way, the screen thickness can also be reduced. This reduction diminishes the danger of unwanted water entrainment. The screen of the present invention also permits increasing the permeability and consequently the dewatering performance for a comparable weft number on the upper or paper side of the screen, due to the special binding configuration of the machine-side wefts in the form of transverse yarns of the second type.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
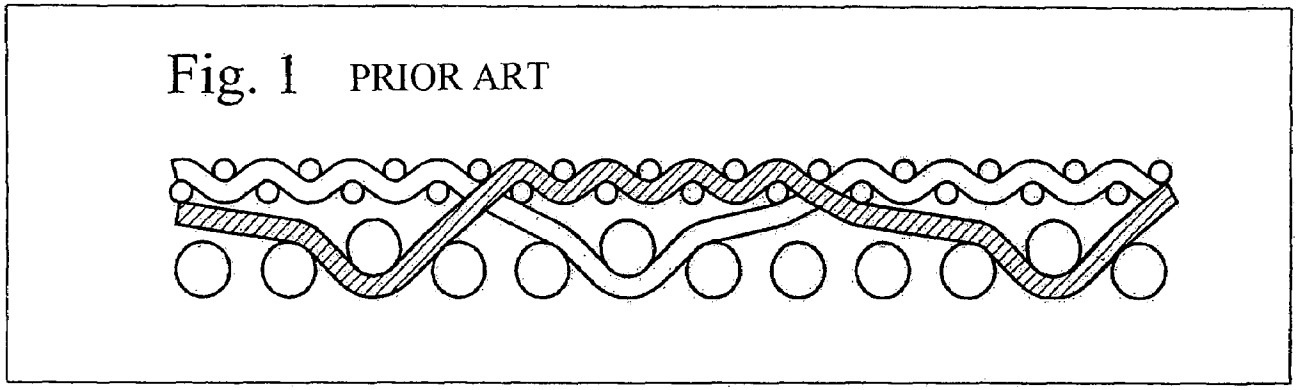
Fig. 1 PRIOR ART
FIG. 1 is a schematic side elevational view of two warp yarns extending in a screen of the prior art according to DE 100 30 650 C1.
Figure 2:
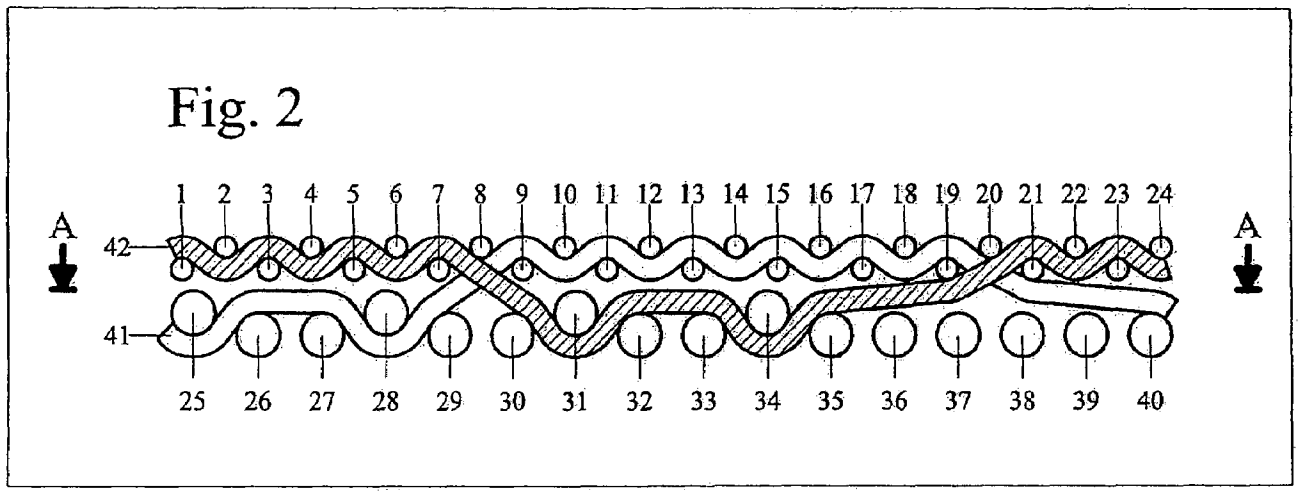
FIG. 2 is a schematic side elevational view of the warp extending corresponding to FIG. 1 of a papermaking screen according to an embodiment of the present invention over a repeat.

FIGS. 1 and 2 illustrate the differences between the known embodiment shown in FIG. 1 and the present invention shown in FIG. 2 based on the extension of comparable warp yarns. In the following description, the warp yarns are also called machine direction yarns (MD yarns), and with the indication longitudinal yarns or with the designation lower and upper warps. The weft yarns in turn are equated to the cross-machine direction yarns (CMD yarns) with the indication transverse yarns or with the indication lower and upper wefts. To be able make the comparison, FIGS. 1 and 2 are prepared with the same number of 24 paper-side wefts or CMD yarns 1 to 24. The following significant differences can be recognized here:

- The distance of the warp intersections or crossings increases from the known eight upper wefts to the present invention of twelve upper wefts. As a result, disruptive intersections occur less often on the paper side with the same number of yarns.
- The number of lower wefts of the present invention is increased. At the same material filling density on the machine side smaller diameters can be used, reducing the thickness.
- The distances between the lower wefts become smaller, the total of the distances remaining the same (same material filling density). The uniformity of the bottom increases in this respect in the binding of the present invention.
- Between the two warp intersections, the warp located in the lower fabric binds with two lower wefts. In conjunction with a second lower warp, the lower fabric binding of the present invention is implemented such that a high degree of openness is achieved, i.e., the screen of the present invention has improved dewatering performance.

Figure 3:
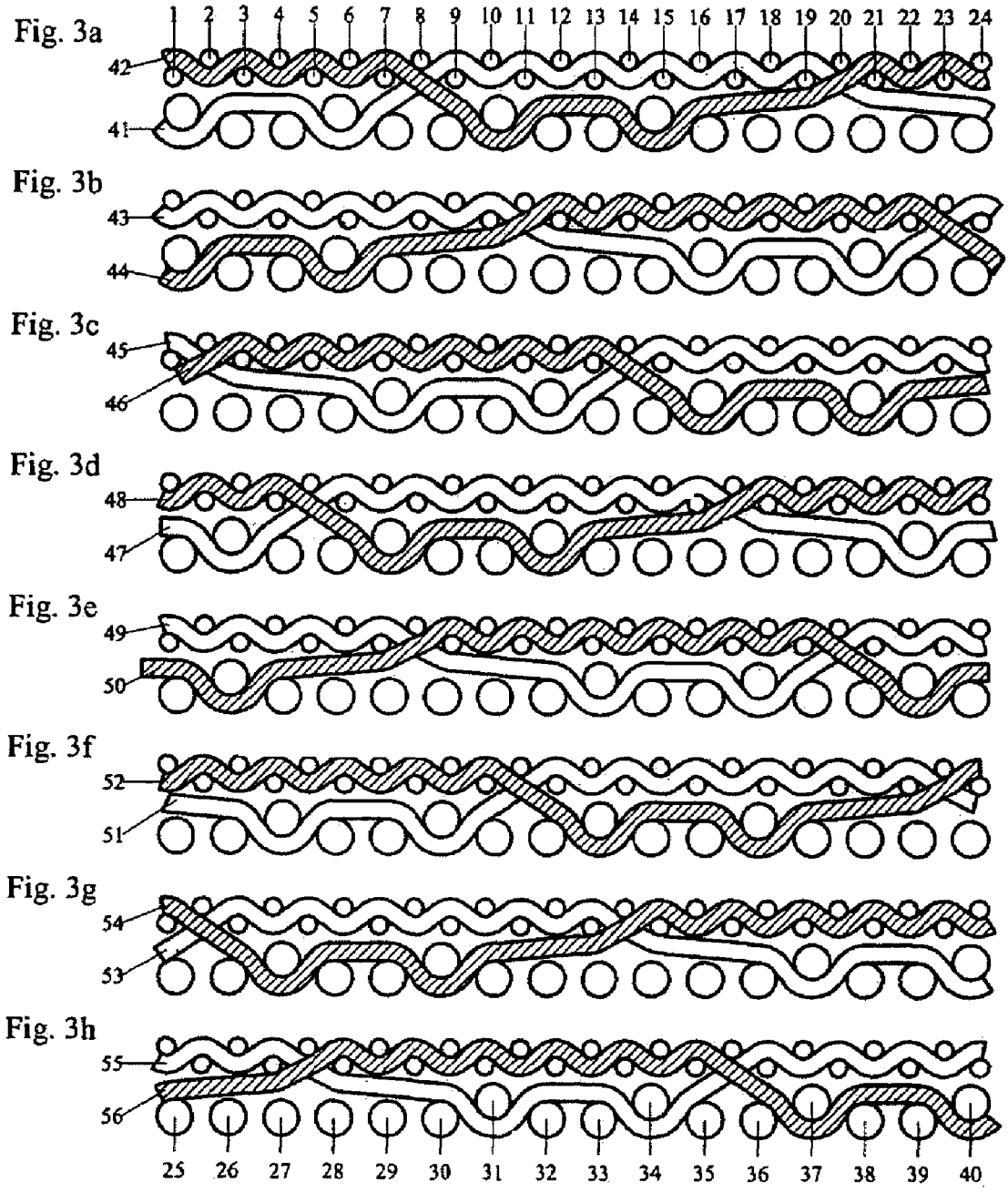
FIGS. 3*a-h* are schematic side elevational views of a papermaking screen with the warp yarns extending for a complete repeat of the binding of the present invention.

In FIG. 3, a complete pattern repeat of the version of the present invention in the form of warp courses or MD yarn courses is shown. The sections of FIGS. 3*a* to 3*h* lie along each pair of warp yarns, beginning from the left next to each other. FIG. 3*a* corresponds otherwise to FIG. 2.

The respective figures show the special type of lower fabric binding. If the lower warp 41 is examined, it binds underneath the lower wefts 25 and 28 (FIGS. 2 and 3*a*). The warp 44 located in the fabric as the fourth longitudinal yarn also binds with the same lower wefts (FIG. 3*b*). The two warps in this area are caused to approach each other by the common, relatively nearby binding on the same weft, and are thus located underneath the warps 42 and 43 located in the upper fabric and which each belong to the pair.

Figure 4:
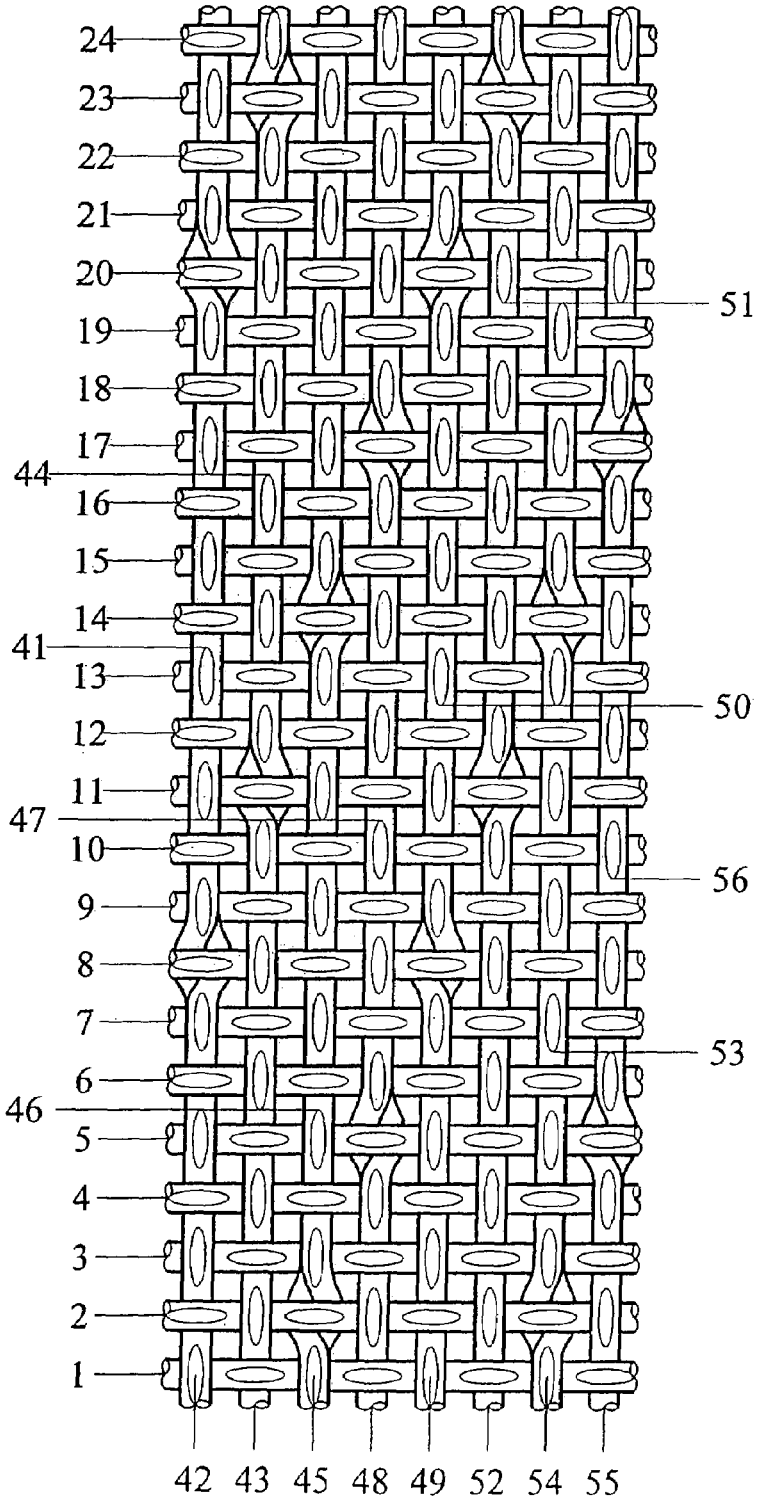
FIG. 4 is a schematic top plan view of a papermaking screen according to an embodiment of the present invention illustrating a complete pattern repeat for the paper side, the machine-side wefts being omitted for the sake of clarity.

FIG. 4 shows the paper side of the fabric of the present invention. For the sake of simpler representation, the lower wefts are not shown in FIG. 4. The upper fabric, as in the prior art of FIG. 1, includes a plain weave formed in alternation by two warp yarns (longitudinal yarns 41 to 56). In contrast to that known solution shown in FIG. 1, between the intersections or crossings under the wefts 2, 5, 8, 11, 14, 17, 20 and 23 there are however always two upper wefts 1, 3, 4, 6, 7, 9, 10, etc., under which alternation never takes place, in the present invention.

Figure 5:
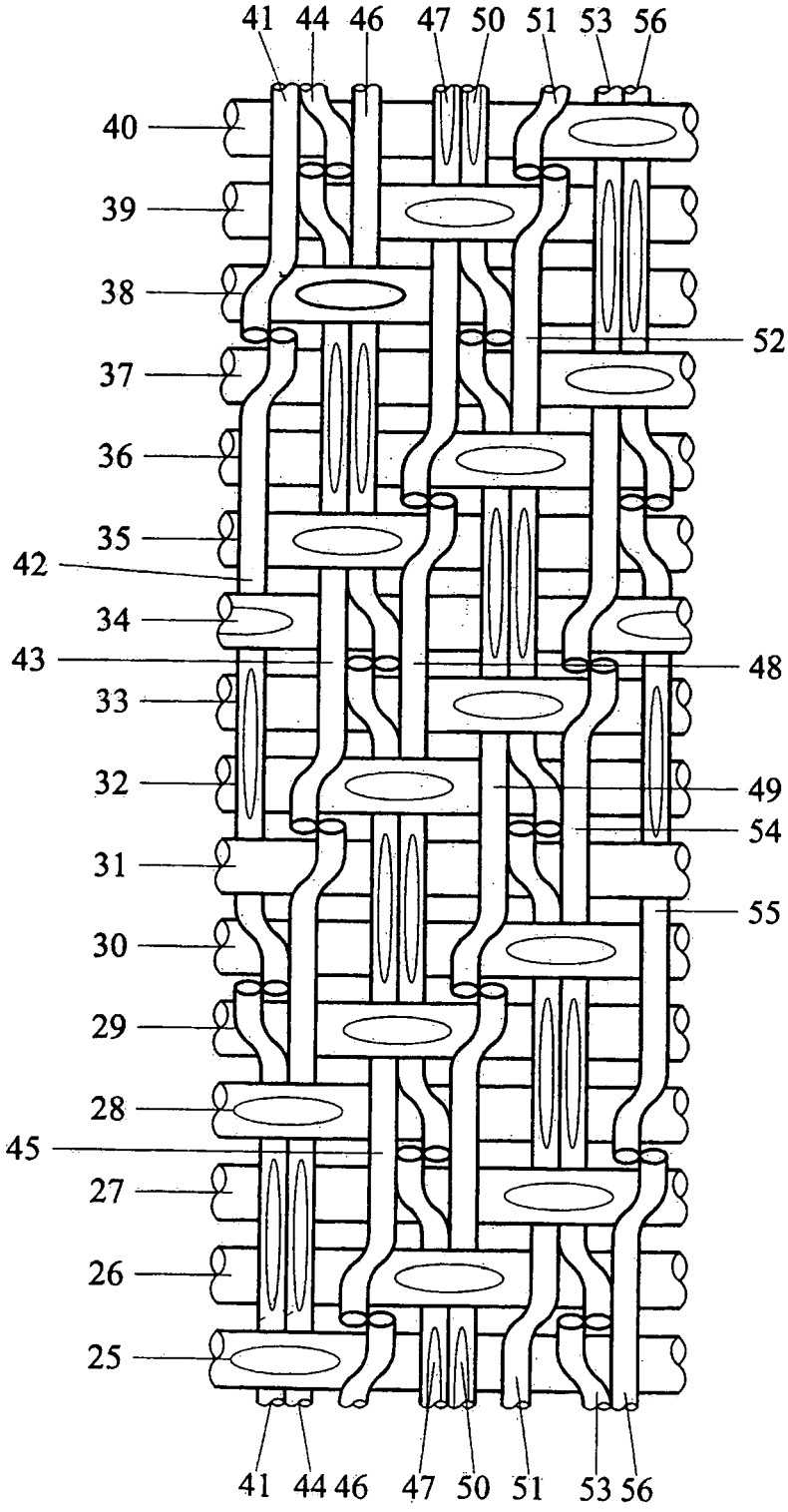
FIG. 5 is a schematic top plan view of a papermaking screen according to an embodiment of the present invention illustrating a complete pattern repeat of the machine side, according to line A-A in FIG. 2.

FIG. 5 shows the lower fabric in a top view, that is to say, a section along line A-A in FIG. 2. This figure shows the special execution of the lower weft bindings which is implemented such that the two outer warp yarns of two warp pairs jointly bind the two lower wefts and in between in turn two wefts are not bound. This arrangement results in the warp yarns located in the lower fabric that are pulled to under the warp yarns located in the upper fabric, forming open areas for good dewatering performance. The warp yarns 41 and 42 in this respect form a pair of longitudinal yarns for producing the paper side (cf. FIG. 3*a*). When the warp yarn 41 binds on the machine side, the warp yarn 42 is on the overlying paper side and vice versa. The adjacent pair of warp yarns 43 and 44 (cf. FIG. 3*b*) performs the same task, but nearby on the right as viewed in the direction to it. In this connection, the warp yarn 41 is always located to the left of the warp yarn 42 and the warp yarn 43 is always located to the left of the warp yarn 44. The outer warp yarns within these two pairs are then the yarns 41 and 44.

These two warp yarns then jointly bind the lower wefts 25 and 28 as transverse yarns of the second type relative to the machine side. Therefore, in this respect, they run underneath these machine-side wefts (cf. FIGS. 3*a, b* and FIG. 5). By bending the lower wefts at a right angle, the two warps are pulled into the center of the binding located underneath the two inner warp yarns 42 and 43. Thus, the warps 41 and 44 can in fact no longer be seen from the top, and an open area is exposed to the left and right of the warps 42 and 43 extending to the top.

While one embodiment has been chosen to illustrate the invention, it will be understood by those skilled in the art that various changes and modifications can be made therein without departing from the scope of the invention as defined in the appended claims.

What is claimed is:

1. A papermaking screen for a sheet forming zone, comprising:

a paper side having first transverse yarns;

a machine side having second traverse yarns;

pairs of adjacent longitudinal yarns alternating on said paper side to form a plain weave with said first transverse yarns, the yarns of each of said pairs forming first and second different crossings within one pattern repeat in extending between said first and second transverse yarns, said first and second crossings alternating, part of said second transverse yarns being bound by at least two of said longitudinal yarns within said one pattern repeat, said longitudinal yarns on said machine side bind two second transverse yarns within a machine-side pattern repeat by extending on outer sides thereof remote from said paper side; and two adjacent pairs of said longitudinal yarns forming two outer longitudinal yarns and two inner longitudinal yarns, said outer longitudinal yarns bind one part of said second transverse yarns without alternating between pairs of bound transverse yarns onto said paper side.

2. A papermaking screen according to claim 1 wherein when viewed in a transverse direction, at least three of said longitudinal yarns extend on said paper side between two adjacent crossings within a repeat without creating an additional crossing with said machine side.

3. A papermaking screen according to claim 1 wherein when viewed in a longitudinal direction, at least two of said transverse yarns extend on said paper side between two adjacent crossings within a repeat without creating additional crossings with said machine side.

4. A papermaking screen according to claim 1 wherein twelve of said first transverse yarns extend between two adjacent crossings on said paper side.

5. A papermaking screen for a sheet forming zone, comprising:

a paper side having first transverse yarns;

a machine side having second traverse yarns;

pairs of adjacent longitudinal yarns alternating on said paper side to form a plain weave with said first transverse yarns, the yarns of each of said pairs forming first and second different crossings within one pattern repeat in extending between said first and second transverse yarns, said first and second crossings alternating, part of said second transverse yarns being bound by at least two of said longitudinal yarns within said one pattern repeat, said longitudinal yarns on said machine side bind two second transverse yarns within a machine-side pattern repeat by extending on outer sides thereof remote from said paper side; and when viewed in a longitudinal direction, at least two of said transverse yarns extending on said paper side between two adjacent crossings within a repeat without creating additional crossings with said machine side.

6. A papermaking screen according to claim 5 wherein when viewed in a transverse direction, at least three of said longitudinal yarns extend on said paper side between two adjacent crossings within a repeat without creating an additional crossing with said machine side.

7. A papermaking screen according to claim 5 wherein twelve of said first transverse yarns extend between two adjacent crossings on said paper side.

8. A papermaking screen according to claim 5 wherein said first transverse yarns are thinner than said second transverse yarns.

9. A papermaking screen according to claim 1 wherein said first transverse yarns are thinner than said second transverse yarns.

* * * * *